US007329143B2

(12) United States Patent
Schrader

(10) Patent No.: US 7,329,143 B2
(45) Date of Patent: Feb. 12, 2008

(54) ELECTRICAL TERMINAL WITH A SPRING FORCE CLAMPING TERMINAL FOR TWO CONDUCTORS

(75) Inventor: Andreas Schrader, Delbrueck (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 11/670,518

(22) Filed: Feb. 2, 2007

(65) Prior Publication Data

US 2007/0178747 A1 Aug. 2, 2007

(30) Foreign Application Priority Data

Feb. 2, 2006 (DE) ..... 10 2006 005 260

(51) Int. Cl.
*H01R 11/20* (2006.01)
*H01R 4/26* (2006.01)
*H01R 4/24* (2006.01)

(52) U.S. Cl. ..... 439/441

(58) Field of Classification Search ..... 439/441, 439/834, 828, 835, 440, 435, 436, 438, 439
See application file for complete search history.

(56) References Cited

U.S. PATENT DOCUMENTS

| | | | | |
|---|---|---|---|---|
| 6,109,952 | A | 8/2000 | Jaag | |
| 6,132,238 | A | 10/2000 | Hartmann et al. | |
| 6,146,217 | A * | 11/2000 | Osada | 439/835 |
| 6,743,061 | B2 | 6/2004 | Jaegerskuepper | |
| 6,814,608 | B2 | 11/2004 | Kollmann | |

FOREIGN PATENT DOCUMENTS

| | | | |
|---|---|---|---|
| DE | 856 012 | C | 11/1952 |
| DE | 18 98 970 | U | 8/1964 |
| DE | 19 17 503 | A1 | 10/1969 |
| DE | 4210020 | A1 | 9/1993 |
| DE | 43 36 965 | A1 | 5/1995 |
| DE | 19711051 | A1 | 9/1998 |
| DE | 298 18 669 | U1 | 2/1999 |
| DE | 19838008 | A1 | 3/1999 |
| DE | 100 37 191 | A1 | 3/2002 |
| DE | 101 03 187 | A1 | 7/2002 |
| DE | 10153170 | C1 | 2/2003 |
| DE | 10 2004 062 855 | A1 | 7/2006 |
| EP | 1 515 397 | A1 | 3/2005 |
| GB | 1 238 243 | | 7/1971 |

OTHER PUBLICATIONS

European Search Report, EP 07 00 1371, dated Apr. 19, 2007.

* cited by examiner

*Primary Examiner*—Javaid H. Nasri
(74) *Attorney, Agent, or Firm*—David S. Safran

(57) ABSTRACT

An electrical terminal with a housing having a terminal chamber formed in it, and two conductor inlets which lead into the terminal chamber for electrical conductors to be connected with a respective conductor connection arrangement formed of a current bar and a clamping leg of a clamping spring, the clamping leg and the current bar forming a spring force clamping terminal for an electrical conductor to be connected, and the two clamping legs each being connected to a contact leg. The electrical terminal can have especially small dimensions by there being only one clamping spring in the housing, the two contact legs being connected to one another and adjoining the housing wall on the edge of the terminal chamber, and by the current bar and the clamping springs being made and arranged such that the current bar is located between the two clamping legs.

16 Claims, 4 Drawing Sheets

ELECTRICAL TERMINAL WITH A SPRING FORCE CLAMPING TERMINAL FOR TWO CONDUCTORS

BACKGROUND OF THE INVENTION

1. Field of the Invention

The invention relates to an electrical terminal with a housing, with a terminal chamber formed in it, and two conductor inlets which lead into the terminal chamber for the electrical conductors to be connected, with one conductor connection arrangement located in the terminal chamber for each conductor inlet, each conductor connection arrangement being formed of a current bar and a clamping leg of a clamping spring, the clamping leg and the current bar forming a spring force clamping terminal for an electrical conductor to be connected, and the two clamping legs each being connected to a contact leg.

2. Description of Related Art

Electrical terminals are used for electrical connection of at least one electrical conductor to a device, especially to a circuit board located in a device. These terminals are often also called printed terminals. In this connection, different electrical terminals are distinguished especially by the different connection possibilities for the conductors to be connected. Thus, terminals with screw, spring force, and insulation piercing clamping terminals as the conductor connecting arrangement are known.

Spring force terminals have become established on the market over time in addition to screw terminals, and for some time also in addition to electrical terminals with insulation piercing connection technology, and are being used in the millions, both as printed terminals and terminal blocks. The advantage of spring force terminals as compared to screw terminals is that the spring force terminals enable more rapid and simpler wiring. In this connection, two different types of spring force terminals are used; loop-shaped tension spring terminals and somewhat U-shaped or V-shaped open clamping springs which are also called leg springs.

To actuate a loop-shaped tension spring terminal, an actuating tool is needed, for example, a screwdriver, which is pressed into the actuating shaft to open the tension spring. In doing so, the tip of the screwdriver tensions the tension spring, by which the clamping site opens. A conductor to be connected can be inserted through a recess into the clamping leg, and after pulling out the screwdriver, is clamped against the contact leg of the tension spring or a current bar which is connected to the tension spring by the lower edge of the recess (compare, Phoenix Contact, product catalog "CLIPLINE 2005, page 19, German Patent Application DE 197 11 051 A1 or German Patent DE 101 53 170 C1).

U-shaped or V-shaped open clamping springs have one clamping leg and one contact or holding leg, the conductor which is to be connected and which is generally a rigid conductor or a conductor with a wire end ferrule, can be inserted into the terminal without a tool. By inserting the conductor, the clamping spring is automatically opened and then the inserted, stripped conductor is pressed by the clamping leg against a current bar. Due to this manner of actuation, these open clamping springs are also designated an edge socket connection or compression spring (compare, Phoenix Contact, product catalog "CLIPLINE 2005, page 20, German Patent DE 102 39 273 A1 and corresponding U.S. Pat. No. 6,814,608 B2).

For electrical connection of the electrical terminal to at least one printed conductor of a circuit board, the contact elements located in the known terminals have at least one solder pin which is inserted into a hole provided in the circuit board and then soldered in it. To do this, generally, the hole is filled beforehand with a solder paste, and then, the solder pin is electrically connected to the corresponding printed conductor by means of reflow soldering.

German Patent DE 198 38 008 B 4 discloses a spring force terminal for use on circuit boards, which has a quick-connect terminal located in the housing, from the wall of which terminal at least one elastic clamping leg is punched, with a clamp end which, together with the opposing wall of the quick-connect terminal, forms a spring force clamping terminal for an electrical conductor to be connected. In the known terminal, two clamping legs located next to one another are punched out of the quick-connect terminal so that the terminal can be used for connecting two conductors which can be inserted into the housing parallel to one another. On the side of the housing opposite the conductor insertion openings, in the known terminal two solder pins connected integrally to the quick-connect terminal emerge and are used for electrical connection of the terminal to the printed conductors of a circuit board.

German Patent DE 42 10 020 C2 discloses the initially described electrical terminal which is likewise made for connecting two conductors. In this electrical terminal, the two conductor inlets are located on two different connection sides of the housing which run at an angle of 90° to one another. On the third side of the overall roughly square housing there is another conductor connection arrangement which can be made as a push-lock terminal or a printed solder connection. Within the housing, there is a roughly W-shaped clamping spring which has two clamping legs which, with a respective adjacent electrically conductive contact wall, each forms a spring force clamping terminal for a respective electrical conductor to be connected. Due to the execution of the W-shaped clamping spring and the arrangement of the conductor inlets on different sides of the housing, the known electrical terminal has a relatively large construction. Moreover, the two electrical conductors to be connected can only be inserted into the electrical terminal at the same time relatively awkwardly and can only be pulled out of the terminal in succession.

Due to the general reduction in the dimensions of the electronic devices used at present and especially also circuit boards, terminals with smaller and smaller dimensions are also desirable. In this connection, various proposals have already be advanced for reducing the dimensions of the electrical terminals and for making available as large a number of connection possibilities as possible at dimensions which are as small as possible. In this connection, so-called two-tier terminals or three-tier terminals which both as screw terminals and also tension spring terminals are noted as belonging to the prior art.

SUMMARY OF THE INVENTION

Therefore, a primary object of this invention is to embody and develop the known electrical terminal such that it has a construction that is as small as possible, and in this connection, enables both simple insertion and also simple removal of the two conductors from the terminal.

This object is achieved in the initially described type of electrical terminal in that the current bar or bars and the clamping springs are made and arranged such that the current bar or bars are located between the two clamping legs and run essentially parallel to the insertion direction of the conductor to be connected. The arrangement of the current bars or preferably a current bar between the two clamping legs yields a very compact construction of the electrical terminal. Moreover, simultaneous insertion of the two electrical leads to be connected is greatly simplified in that the current bar or bars run parallel to the insertion direction of the conductor to be connected. For the electrical terminal in accordance with the invention, thus, the two electrical conductors to be connected are inserted into the housing from the same direction and pulled out of the housing parallel to one another so that both insertion and also extraction of the two conductors from the housing can be easily done with one hand.

Fundamentally, it is possible that, for each electrical conductor to be connected, there is a respective conductor connection arrangement comprised of its own current bar and its own clamping spring. However, to simplify production of the electrical terminal, in accordance with the invention, it is advantageously provided that only one clamping spring and also only one current bar are located in the housing. The two clamping legs are connected to one another on the end of the contact leg connected to the clamping legs, which end is away from the clamping legs, the two contact legs adjoining the edge of the terminal chamber on the housing wall and preferably running at an angle of roughly 90° to one another. This ensures that the two clamping legs each clamp an electrical conductor to be connected independently of one another, i.e., opening of one clamping site has no effect on the clamping force at the other clamping site.

If, as stated above, there is only one current bar in the insulating housing, a respective side of the current bar with a respective clamping leg forms a spring force clamping terminal. The current bar is preferably formed of two current bar sections which run parallel to one another, the two current bar sections being interconnected via a bent connection region which is directed opposite the conductor insertion direction. The current bar is thus bent along its transverse axis, the two current bar sections either lying directly on one another or being a short distance from one another. Because the bent connection region of the current bar is directed toward the conductor inlets, the conductors to be inserted are routed through the rounding of the connection region gently into the clamping site.

Fundamentally, the electrical terminal in accordance with the invention can also be used solely to connect two electrical conductors which are to be connected via a current bar. However, preferably, the electrical terminal is intended for use on circuit boards so that it is made as a so-called printed terminal. Therefore, the current bar is preferably connected integrally to the plug part which has at least one solder pin. The current bar and the plug part are thus formed by a common metal part which can be mechanically connected to the clamping spring. For this purpose, the clamping spring has notches or projections which are used to accommodate the corresponding sections of the metal part so that the clamping spring and the metal part can be mated for mechanical connection. Generally, additional fixing by means of one or more welds between the clamping spring and the metal part takes place.

According to one preferred configuration of the electrical terminal in accordance with the invention, there is at least one actuating pushbutton in the housing which can be moved out of a first position in which the actuating pushbutton does not deflect the clamping leg, into a second position in which the actuating pushbutton deflects the clamping leg against its spring force. In the second position of the actuating pushbutton, the spring force clamping terminal or terminals can thus be opened so that one conductor or the two conductors can be pulled out of or inserted into the terminal.

This actuating pushbutton is fundamentally known from the prior art. As initially mentioned, an electrical conductor can be inserted directly into the known electrical terminals without using a tool, but generally a connected conductor cannot be pulled out of the terminal or can be only be pulled out with relatively great expenditure of force and with damage to the conductor or to the clamping spring. The actuating pushbutton is thus used, first of all, to deflect the clamping leg of the clamping spring against a spring force, by which the spring force clamping terminal is opened so that a connected conductor can be pulled out of the terminal. Moreover, the actuating pushbutton can also be used for easier connection of a rigid conductor or to connect a flexible conductor.

Preferably, the electrical terminal in accordance with the invention has simply one actuating pushbutton which is made such that it opens the two spring force clamping terminals at the same time in its second position. Moreover, the actuating pushbutton is made such that conductor inlets for inserting the conductors to be connected together are formed by the housing and the actuating pushbutton. The actuating pushbutton thus has two insert channels for the conductors to be connected. In this way, a further reduction of the dimensions of the electrical terminal is possible since space for accommodating the actuating pushbutton need not be made available in the housing in addition to the conductor inlets.

In order to facilitate accessibility of the actuating pushbutton even for small dimensions of the electrical terminal, preferably, there is a receiver in the actuating pushbutton which is made for insertion of a tool, especially the tip of a screwdriver. If several electrical terminals next to one another are connected to form a terminal block, actuation of the actuating pushbutton with one finger at contact spacings of 5 mm or less is only possible with difficulty, moreover, there is the danger that the actuating pushbutton of a terminal located next to it is inadvertently actuated at the same time. This problem can be easily solved by the possibility of inserting the tip of a screwdriver into the receiver which is made in the actuating pushbutton.

In particular, there is now a host of possibilities for embodying and developing the electrical terminal in accordance with the invention as will be apparent from the following description of a preferred embodiment in conjunction with the accompanying drawings.

DETAILED DESCRIPTION OF THE INVENTION

Figure 1:
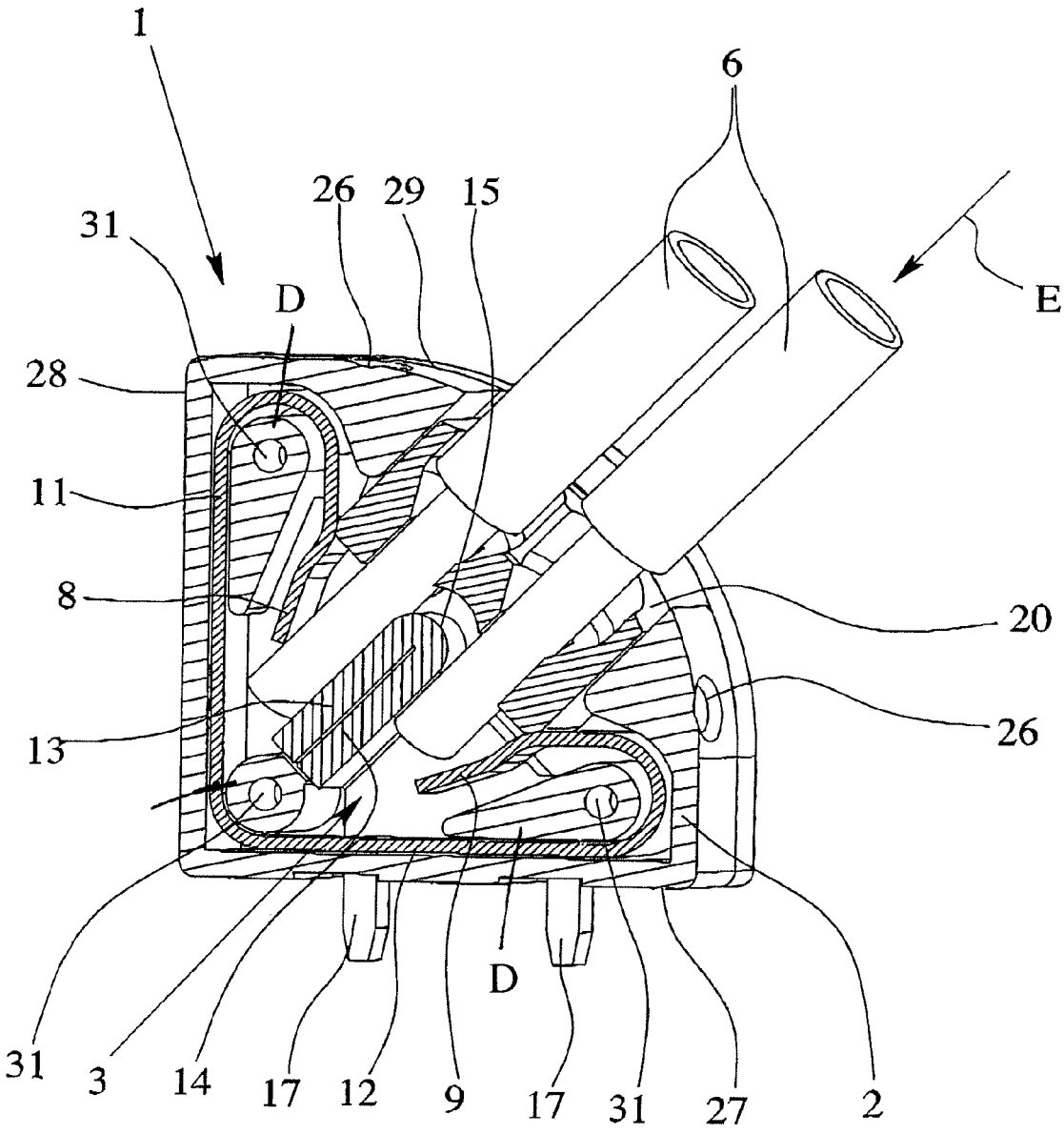
FIG. 1 shows an embodiment of the electrical terminal in accordance with the invention, in cross section.

FIG. 1 shows an electrical terminal 1 with a housing 2 which is made of an insulating material and in which a terminal chamber 3 and two conductor inlets 4, 5, leading into the terminal chamber 3, are formed for two electrical conductors 6 to be connected. In the terminal chamber 3, there is a respective conductor connection arrangement for each conductor inlet 4, 5; the connection arrangements each comprise a current bar 7 and a clamping leg 8, 9, a respective clamping leg 8, 9, forming a spring force clamping terminal for an electrical conductor 6 to be connected together with a facing side of the current bar 7. The two clamping legs 8, 9 are part of a clamping spring 10 which also has two contact legs 11, 12 which, on the one hand, are each connected to a respective clamping leg 8, 9, and on the other hand, are connected to each other. As is apparent from FIG. 1, the two contact legs 11, 12 run essentially perpendicular to one another, the contact legs 11, 12 adjoining an edge of the connecting chamber 3 on a respective one of the housing walls. To fix the clamping spring 10, the housing 2 has catch domes D made accordingly, the clamping spring 10 being held between the catch domes D and the housing wall.

The current bar 7 is formed of two current bar sections 13, 14, which run parallel to each other, and the clamping spring 10 is made and arranged such that the current bar 7 is located between the two clamping legs 8, 9 of the clamping spring 10 and runs parallel to the insertion direction E of the conductors 6 to be connected. The current bar 7 is thus located between the clamping legs 8, 9 that are bent into the interior of the terminal chamber 3, while the contact legs 11, 12 adjoin the edge of the terminal chamber 3.

If an electrical conductor 6 to be connected is inserted into the terminal 1 through a conductor inlet 4, 5, the conductor 6 presses on the clamping leg 8, 9, by which the clamping site formed between the free end of the clamping leg 8, 9 and the current bar 7 is automatically opened. The stripped end of the conductor 6 to be connected is then pressed by the spring force of the clamping leg 8, 9 with the required pressing force against the current bar 7 so that the desired electrical contact is made.

The current bar 7 formed of the two current bar sections 13, 14, that are bent toward one another is located in the housing 2 such that the bent connecting region 15 is directed opposite the insertion direction E, i.e., in the direction of the conductor inlets 4, 5. The rounding of the bent connection region 15 provides advantageously for a conductor 6 which is to be connected to be introduced gently into the clamping site between the respective current bar section 13, 14, and the free end of the associated clamping leg 8, 9, when inserted into the terminal 1. Angling of the electrical conductor 6 to be connected upon insertion is thus easily prevented.

The above described execution of the clamping spring 10 shown in the figures with the two contact legs 11, 12, adjoining the terminal chamber 3 ensures that deflection of one of the clamping legs 8, 9, does not have any effect on the clamping force of the other clamping leg 9, 8 so that the spring forces of the two clamping legs 8, 9 are decoupled from one another, and thus, two conductors 6 can be inserted independently of one another into the respective spring force clamping terminal. In particular, it is also possible to connect two electrical conductors 6 having different cross sections/diameters to the terminal 1.

The electrical terminal 1 shown in the figures is designed for use on circuit boards so that the current bar 7 is connected to a plug part 16 which has two solder pins 17. The current bar 7 and the plug part 16 with the two solder pins 17 form a one-piece metal part 18 as is especially apparent from FIGS. 2 & 3. Of course, the current bar 7 can be connected to a socket part instead of to a plug part 16 when the terminal 1 is not to be made as a circuit board terminal.

The current-carrying metal part 18 can be produced as a simple punched and bent part made, for example, of a high-quality copper alloy, the surface of the metal part 18 preferably having a lead-free galvanic nickel or tin layer. For the likewise one-piece clamping spring 10, conversely, generally, spring steel, especially a high-strength chromium-nickel spring steel, can be used which optimally ensures the necessary spring force, and thus, the necessary contact force. For easier preassembly of the clamping spring 10 and the metal part 18, notches 19 are punched out in the clamping spring 10, into which corresponding notches of the metal part 18 can be inserted. Moreover, in general an additional connection by means of spot welds between the contact spring 10 and the metal part 18 takes place so that relative movements of the two parts do not occur.

Instead of the above described one-piece execution of the current bar 7 and the clamping spring 10 shown in the figures, fundamentally, also two individual clamping springs and two individual current bars can also be used, then a respective clamping spring and current bar form a spring force clamping terminal. However, the above described integration of the current bar 7 and the clamping spring 10 has the advantage that altogether fewer components need be installed, by which the production of the electrical terminal 1 overall is simplified.

In the housing 2 of the electrical terminal 1, an actuating pushbutton 20 is movably located and is used especially for opening the clamping sites, and thus, for releasing the connected electrical conductor 6, so that the conductor can be pulled out of the electrical terminal 1 again. To do this, the actuating pushbutton 20 can be pressed out of a first position (FIG. 4) in which the actuating pushbutton 20 does not deflect the clamping leg 8, 9, into a second position (FIG. 1) in which the end of the actuating pushbutton 20 projecting into the terminal chamber 3 deflects the clamping legs 8, 9 against their spring force. Pressing the actuating pushbutton 20 into the terminal chamber 3 is also feasible in order to open the contact point between the current bar 7 and the free end of the clamping legs 8, 9 when a less stiff electrical conductor 6 is to be inserted. In fact, it is also possible, instead of a common actuating pushbutton for the two spring force clamping terminals, to provide two actuating pushbuttons which are separate from one another and which then each open only one clamping site.

Figure 4:
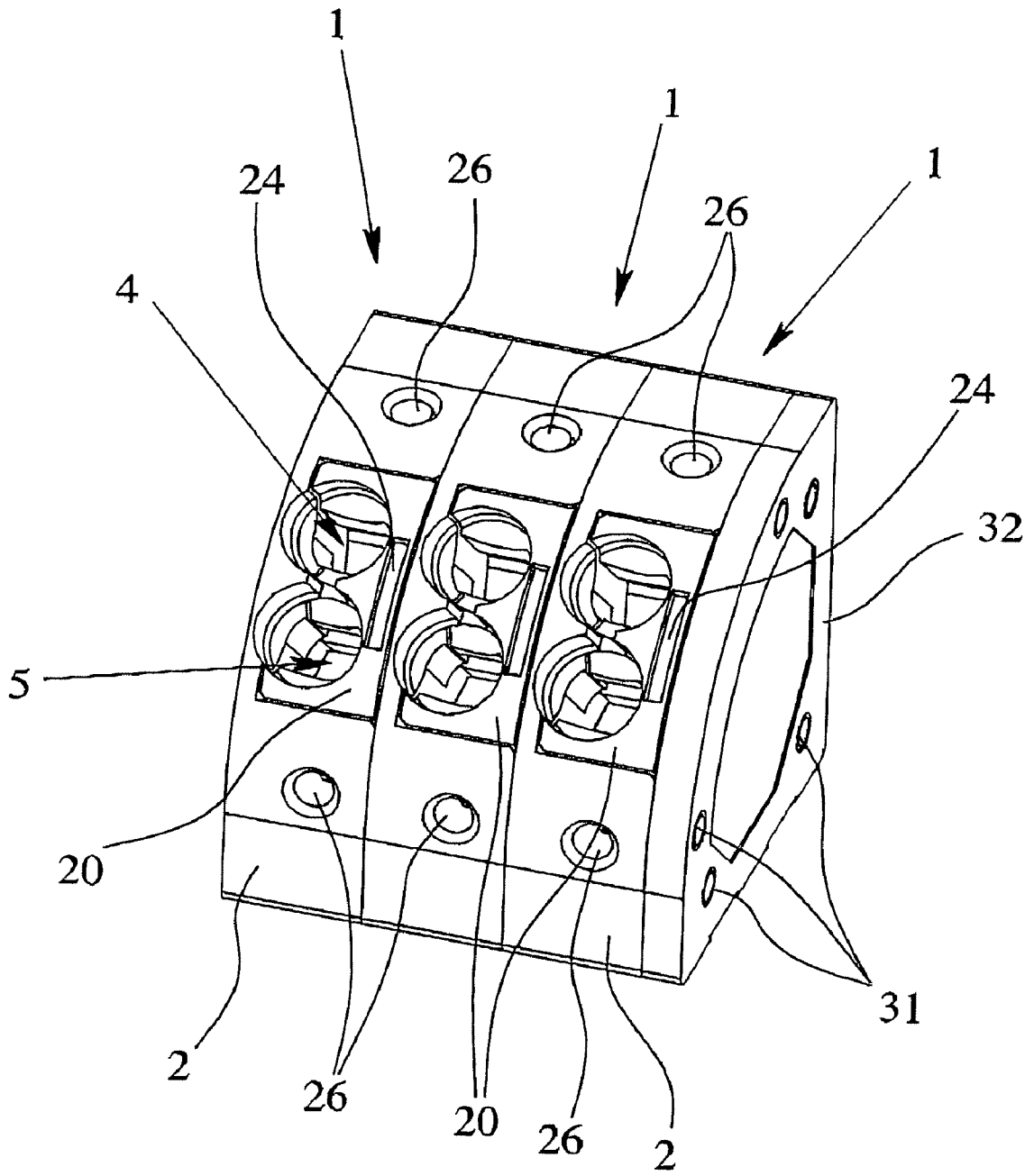
FIG. 4 shows three electrical terminals of the type shown in FIG. 1 arranged in a row next to one another.

The actuating pushbutton 20 is located in the housing 2 such that the actuating direction runs parallel to the insertion direction E so that the actuating pushbutton 20 is automatically pressed back out of the second position into the first position by the spring force of the clamping legs 8, 9. As is especially apparent from FIG. 2, in the actuating pushbutton 20, two inlet channels 21, 22 are formed which together with the housing 2 form the conductor inlets 4, 5 for insertion of the conductor 6 to be connected. FIG. 4 shows that roughly ¾ of the conductor inlets 4, 5 are made in the actuating pushbutton 20 and roughly ¼ of the conductor inlets 4, 5 are made in the side wall 23 of the housing 2. In this way, an electrical terminal 1 can be implemented with an especially small contact spacing.

Figure 2:
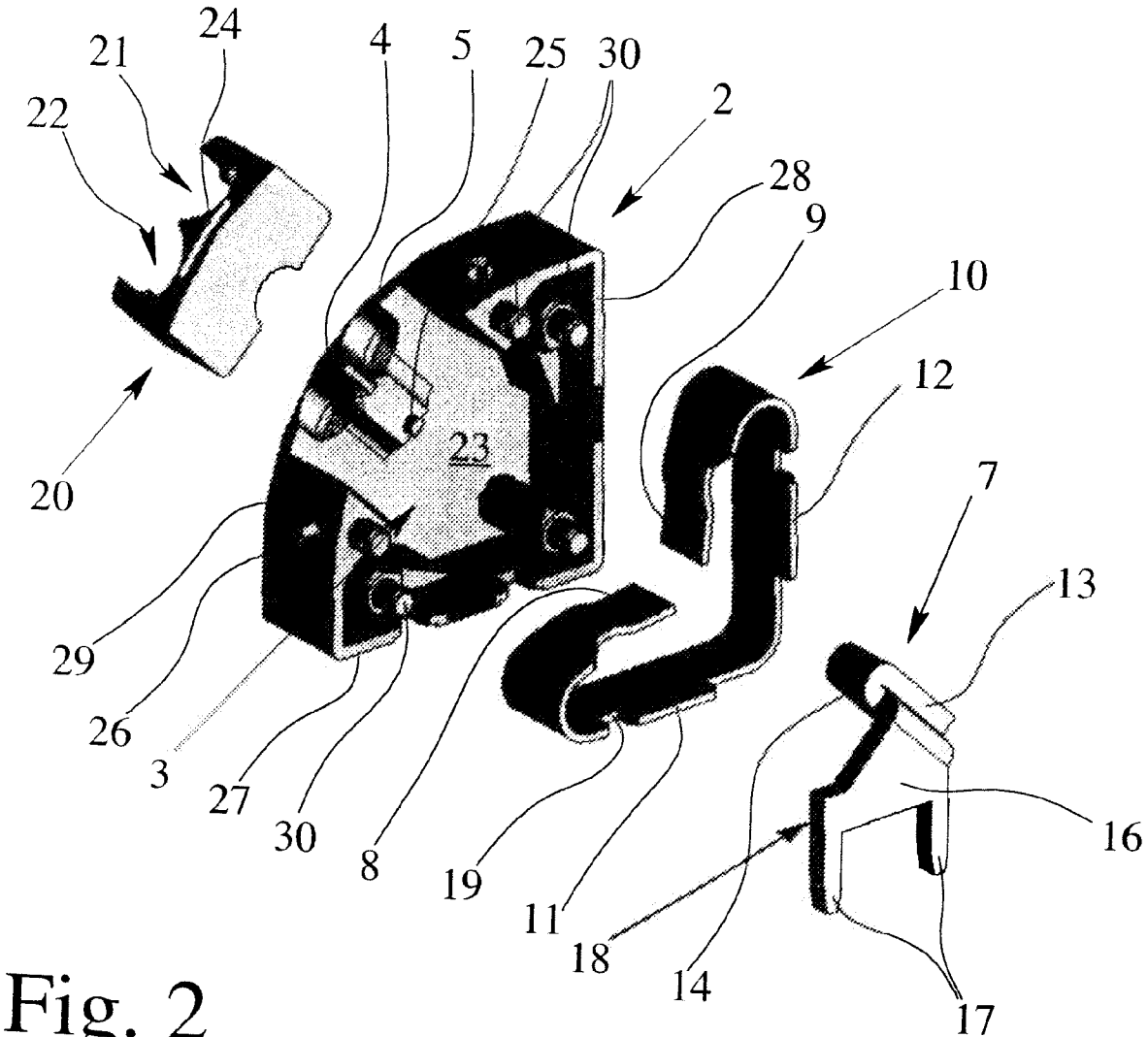
FIG. 2 is an exploded view of the electrical terminal shown in FIG. 1.
Figure 3:
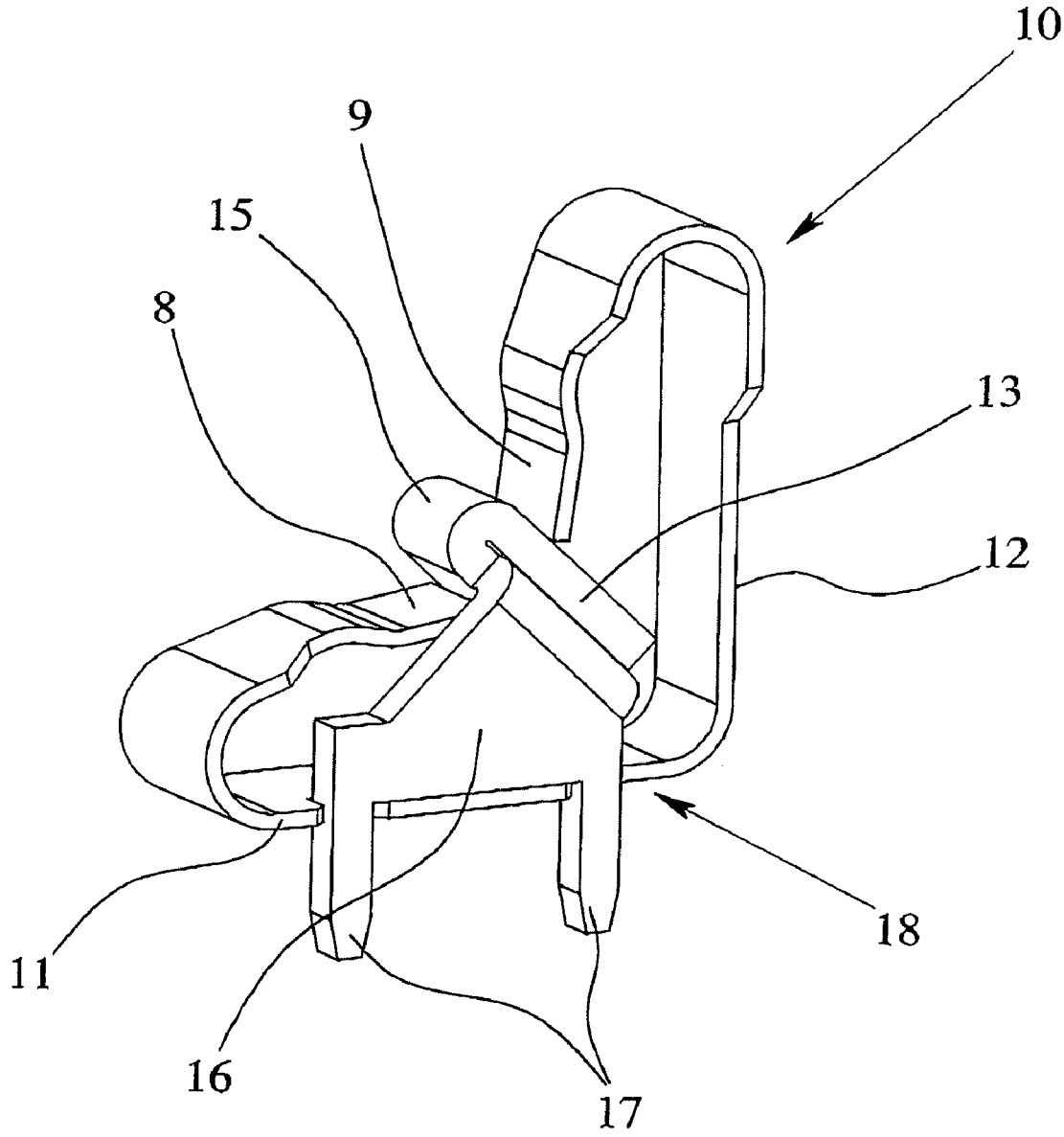
FIG. 3 shows an enlarged perspective view of the clamping spring and of the metal part of the electrical terminal.

FIGS. 2 & 4, also shown that a receiver 24 for insertion of a tool, especially the tip of a screwdriver, is formed in the actuating pushbutton 20. In this way, the actuating pushbutton 20 can be easily and comfortably pressed in, even for very small dimensions of the electrical terminal 1. The actuating pushbutton 20, which is laterally guided in the housing 2, is secured against the actuating pushbutton 20 being pulled out of the housing 2 by a projection 25 that is formed in the housing 2.

In the housing 2, there are two openings 26 for inserting a test plug which are made and arranged such that the test plug can be inserted through a respective opening 26 into a contact point in the terminal chamber 3. This terminal 1 shown in the figures, among others, thus, also has a compact construction in that the housing 2, having a roughly ¼-circle-shaped cross section with two faces 27, 28 which run perpendicular to one another and a third arc-shaped face 29 which connects the two straight faces 27, 28. In this regard, the two conductor inlets 4, 5 are located in the arc-shaped face 29, the conductor inlets 4, 5 and thus, also the connected electrical conductor 6 and the current bar 7, running at an angle of 45° to the two straight faces 27, 28. The two solder pins 17 of the plug part 16 can emerge out of the housing 2 from one of the two straight faces 27, 28, depending on the arrangement of the metal part 18 and the execution of the housing 2. This enables both horizontal and also vertical mounting of the electrical terminal 1 on one circuit board.

FIG. 4 shows three electrical terminals 1 which are locked together into a terminal block. To do this, on the housing 2, catch elements in the form of catch pegs 30 and corresponding catch holes 31 are made. As is apparent from FIG. 2, the housing 2 has only one side wall 23 so that the other side surface of the housing 2 is open. This open side surface of the housing 2 is closed either by the side wall 23 of the housing 2 of an adjacent terminal 1 or by a separate cover 32 so that the electrical terminal 1 and the electrical terminal block composed of several terminals 1 have the required class of protection.

What is claimed is:

1. Electrical terminal, comprising a housing with a terminal chamber formed in the housing and two conductor inlets which lead into the terminal chamber for electrical conductors to be connected, a conductor connection arrangement located in the terminal chamber for each conductor inlet, each conductor connection arrangement having a current bar and a clamping leg of a clamping spring, the clamping leg and the current bar forming a spring force clamping terminal for an electrical conductor to be connected, and the clamping leg being connected to a contact leg, wherein only one said clamping spring is located in the housing, the contact legs of the conductor connection arrangements being connected to one another on an end which is away from the clamping legs of the conductor connection arrangements and adjoining a housing wall on an edge of the terminal chamber, and wherein the current bar and the clamping spring are made and arranged such that the current bar is located between the clamping legs of the conductor connection arrangements and runs essentially parallel to an insertion direction of the conductors to be connected;

wherein there is only one current bar in the housing, each side of the current bar forming a spring force clamping terminal with a respective clamping leg; and wherein the current bar is formed of two current bar sections which run parallel to one another, the two current bar sections being interconnected via a bent connection region which faces opposite the conductor insertion direction, and each current bar section forming a spring force clamping terminal with a respective clamping leg.

2. Electrical terminal in accordance with claim 1, wherein the current bar is connected to a plug part which has at least one solder pin.

3. Electrical terminal in accordance with claim 1, wherein the clamping spring, the current bar and a plug part which has at least one solder pin are mechanically connected to one another.

4. Electrical terminal in accordance with claim 3, wherein the clamping spring has notches which are used to accommodate the current bar and the at least one solder pin.

5. Electrical terminal in accordance with claim 1, wherein there is at least one actuating pushbutton in the housing which is movable out of a first position in which the actuating pushbutton does not deflect at least one of the clamping legs, into a second position in which the actuating pushbutton deflects the least one of the clamping legs so that, in the second position of the actuating pushbutton, the spring force clamping terminal is opened so that a conductor can be pulled out of or inserted into the respective terminal.

6. Electrical terminal in accordance with claim 5, wherein the conductor inlets for inserting the conductors to be connected are formed by the housing and the at least one actuating pushbutton.

7. Electrical terminal in accordance with claim 5, wherein the at least one actuating pushbutton is located in the housing such that an actuating direction thereof runs parallel to the insertion direction, and wherein the at least one actuating pushbutton is automatically pressed back out of the second position into the first position by spring force of the clamping legs.

8. Electrical terminal in accordance with claim 5, wherein a receiver is provided in the at least one actuating pushbutton, the receiver being adapted for insertion of a tool therein.

9. Electrical terminal in accordance with claim 5, wherein there is only one actuating pushbutton in the housing which opens both spring force clamping terminals in the second position at the same time.

10. Electrical terminal in accordance with claim 5, wherein a guide for the at least one actuating pushbutton is formed in the housing.

11. Electrical terminal in accordance with claim 1, wherein at least one opening for a test plug is formed in the housing.

12. Electrical terminal in accordance with claim 1, wherein the housing has a roughly ¼-circle-shaped cross section with two faces which run perpendicular to one another and a third, arc-shaped, face which connects the two straight faces.

13. Electrical terminal in accordance with claim 12, wherein the current bar is connected to a plug part which has at least one solder pin; wherein the two conductor inlets are located in the arc-shaped face and wherein the plug part emerges from the housing at one of the two straight faces.

14. Electrical terminal in accordance with claim 12, wherein the housing has catch elements for connection of the housing to a like second housing.

15. Electrical terminal in accordance with claim 14, wherein one side surface of the housing is open and wherein this side surface is closable by means of a said like second housing.

16. Electrical terminal in accordance with claim 12, wherein one side surface of the housing is open and wherein this side surface is closable by means of a cover.

* * * * *